US010629359B2

(12) United States Patent
Shirouzu

(10) Patent No.: US 10,629,359 B2
(45) Date of Patent: Apr. 21, 2020

(54) AC REACTOR

(71) Applicant: FANUC CORPORATION, Yamanashi (JP)

(72) Inventor: Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 37 days.

(21) Appl. No.: 15/920,682

(22) Filed: Mar. 14, 2018

(65) Prior Publication Data

US 2018/0268985 A1 Sep. 20, 2018

(30) Foreign Application Priority Data

Mar. 17, 2017 (JP) ..... 2017-052730

(51) Int. Cl.
*H01F 27/28* (2006.01)
*H01F 27/26* (2006.01)
*H01F 37/00* (2006.01)

(52) U.S. Cl.
CPC ..... *H01F 27/263* (2013.01); *H01F 27/28* (2013.01); *H01F 37/00* (2013.01)

(58) Field of Classification Search
CPC ..... H01F 27/00–36
USPC ..... 336/65, 83, 90, 92, 170–173, 210–215, 336/233–234
See application file for complete search history.

(56) References Cited

U.S. PATENT DOCUMENTS

| | | | |
|---|---|---|---|
| 4,912,618 A | 3/1990 | Krinickas, Jr. | |
| 10,008,322 B2 | 6/2018 | Bhide et al. | |
| 2018/0268985 A1 | 9/2018 | Shirouzu | |

FOREIGN PATENT DOCUMENTS

| | | | | |
|---|---|---|---|---|
| CN | 202487364 U | 10/2012 | | |
| CN | 202601375 U | 12/2012 | | |
| CN | 208240436 U | 12/2018 | | |
| DE | 102018117512 A1 * | 1/2019 | ..... | H01F 27/362 |
| JP | H03502279 A | 5/1991 | | |
| JP | H08321424 A | 12/1996 | | |
| JP | H09045543 A | 2/1997 | | |
| JP | H11204340 A | 7/1999 | | |
| JP | 200193737 A | 4/2001 | | |
| JP | 2009-283706 A | 12/2009 | | |
| JP | 2016122830 A | 7/2016 | | |
| WO | 2015142354 A1 | 9/2015 | | |

* cited by examiner

*Primary Examiner* — Tuyen T Nguyen
(74) *Attorney, Agent, or Firm* — RatnerPrestia

(57) ABSTRACT

An AC reactor according to an embodiment of this disclosure includes a peripheral iron core constituted of partial peripheral iron cores divided by a plurality of dividing surfaces, for enclosing an outer periphery; at least three iron core coils contacting, connected to, or magnetically connected to an inner surface of the peripheral iron core, each of the iron core coils including an iron core and a coil wound around the iron core; and a securing member for securing the partial peripheral iron cores to maintain the peripheral iron core in contact at the dividing surfaces.

1 Claim, 11 Drawing Sheets

AC REACTOR

This application is a new U.S. patent application that claims benefit of JP 2017-052730 filed on Mar. 17, 2017, the content of 2017-052730 is incorporated herein by reference.

BACKGROUND OF THE INVENTION

1. Field of the Invention

The present invention relates to an AC reactor, and more specifically relates to an AC reactor having a peripheral iron core.

2. Description of Related Art

Alternating current (AC) reactors are used in order to reduce harmonic current occurring in inverters, etc., to improve input power factors, and to reduce inrush current to the inverters. AC reactors have an iron core made of a magnetic material and a coil wound around the iron core.

Conventional three-phase AC reactors each include three-phase coils arranged in a linear manner (for example, Japanese Unexamined Patent Publication (Kokai) No. 2009-283706). Each coil has an output terminal and an input terminal. In conventional three-phase AC reactors, the three-phase coils are arranged (apposed) in parallel and in a linear manner, to align the three-phase coils and the input and output terminals.

SUMMARY OF THE INVENTION

However, in recent years, three-phase AC reactors having three-phase coils that are arranged (apposed) neither in parallel nor in a linear manner are reported. In three-phase AC reactors each having iron cores disposed inside a peripheral iron core, it is difficult to wind wires on the iron cores formed integrally with the peripheral iron core. For this problem, the approach of dividing the peripheral iron core may be adopted. However, in such a case, gaps occurring between dividing surfaces cause variations in inductance. Therefore, it is necessary that the peripheral iron core be secured and maintained in tight contact at the dividing surfaces without any gaps therebetween. Misalignment between the dividing surfaces, owing to mechanical vibration such as magnetostriction occurring in use, may change the inductance magnetic saturation characteristics or cause the occurrence of noise.

An AC reactor according to an embodiment of this disclosure includes a peripheral iron core constituted of partial peripheral iron cores divided by a plurality of dividing surfaces, for enclosing an outer periphery; at least three iron core coils contacting, connected to, or magnetically connected to an inner surface of the peripheral iron core, each of the iron core coils including an iron core and a coil wound around the iron core; and a securing member for securing the partial peripheral iron cores to maintain the peripheral iron core in contact at the dividing surfaces.

BRIEF DESCRIPTION OF THE DRAWINGS

The objects, features and advantages of the present invention will become more apparent from the following description of embodiments along with the accompanying drawings. In the accompanying drawings.

DETAILED DESCRIPTION OF THE INVENTION

An AC reactor according to the present invention will be described below with reference to the drawings. However, the technical scope of the present invention is not limited to embodiments, but embraces the invention described in claims and equivalents thereof.

Figure 1:
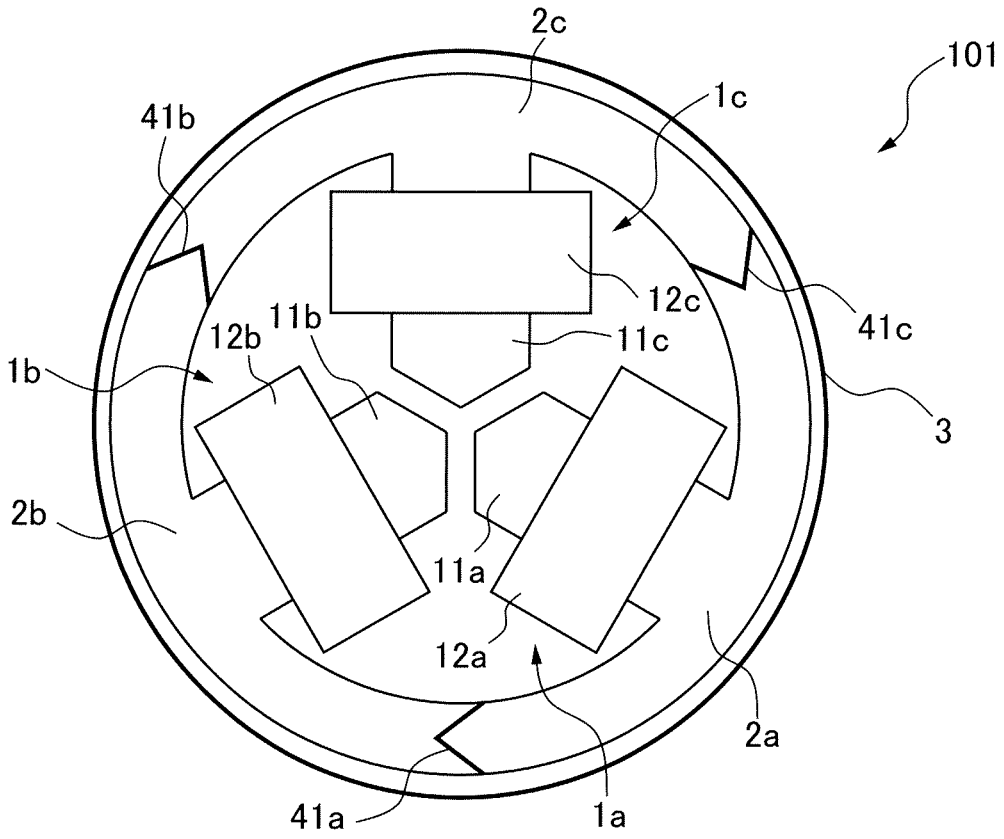
FIG. 1 is a plan view of an AC reactor according to a first embodiment.

An AC reactor according to a first embodiment of this disclosure will be first described. FIG. 1 is a plan view of the AC reactor according to the first embodiment. An AC reactor 101 according to the first embodiment has a peripheral iron core 2, at least three iron core coils (1*a*, 1*b*, and 1*c*), and a securing member 3.

Figure 2A:
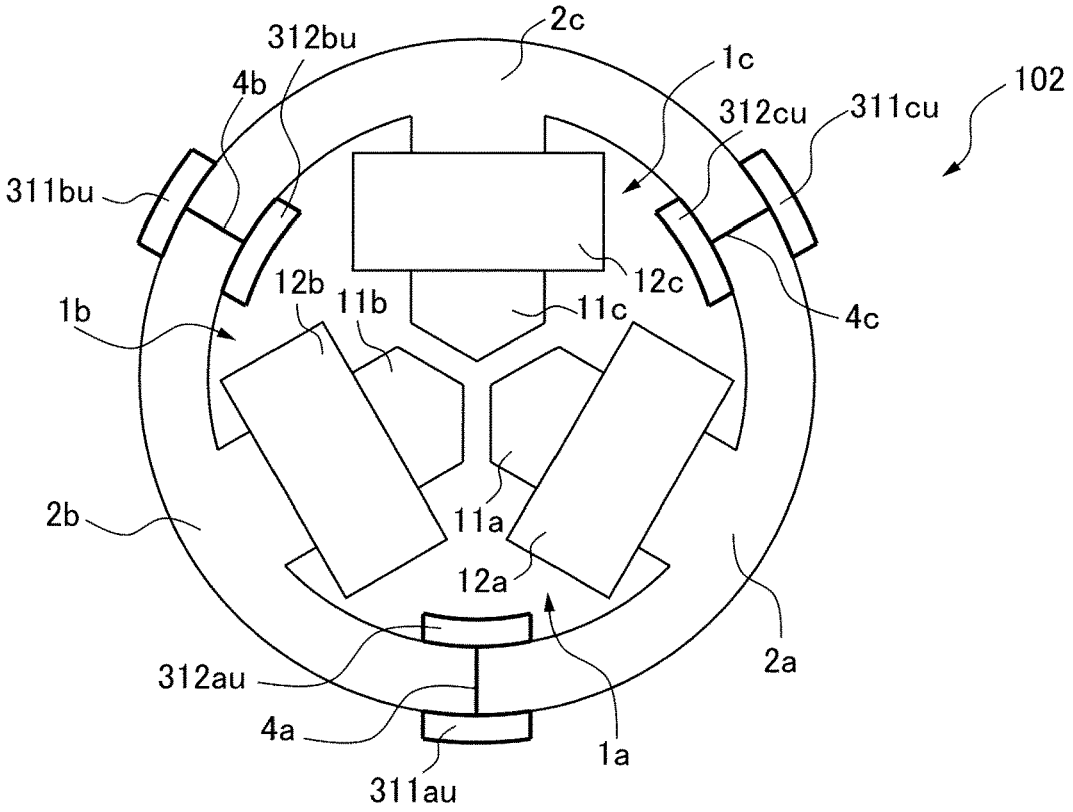
FIG. 2A is a plan view of an AC reactor according to a second embodiment.
Figure 2B:
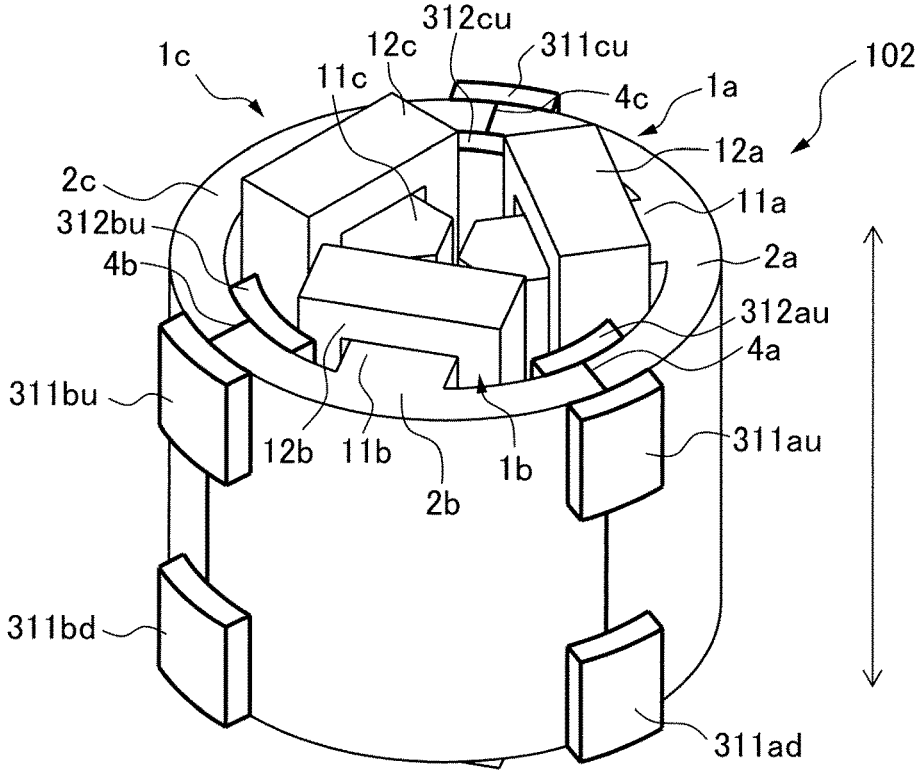
FIG. 2B is a perspective view of the AC reactor according to the second embodiment.

The peripheral iron core 2 is constituted of partial peripheral iron cores (2*a*, 2*b*, and 2*c*) divided by a plurality of dividing surfaces (41*a*, 41*b*, and 41*c*) so as to enclose an outer periphery. For example, when the peripheral iron core of the three-phase AC reactor is connected to iron cores of the iron core coils, the peripheral iron core 2 is preferably divided into three, as the number of the iron core coils is three. Thus, in the three-phase AC reactor, the number of the dividing surfaces (41*a*, 41*b*, and 41*c*) is also three. However, the present invention is not limited to this embodiment, and four or more dividing surfaces may be provided in the three-phase AC reactor. In the AC reactor 101 shown in FIG. 1, the peripheral iron core and the iron cores may be made of electromagnetic steel sheets, amorphous alloy films, or a magnetic material such as a pressed powder core or ferrite. When the peripheral iron core and the iron cores are made of electromagnetic steel sheets or amorphous alloy films, the electromagnetic steel sheets or the amorphous alloy films are laminated in the direction of the double-headed arrow of FIG. 2B. Irrespective of the material of the iron cores, the direction of the double-headed arrow of FIG. 2B is defined as a lamination direction. The peripheral iron core 2 preferably has an outside shape of a circle or a regular polygon such as a regular triangle, a square, a regular hexagon, or a regular octagon, but may have an outside shape of an ellipse or an irregular polygon.

At least three iron core coils (1*a*, 1*b*, and 1*c*) contact, are connected to, or are magnetically connected to an inner surface of the peripheral iron core 2. Each of the iron core coils includes an iron core (11*a*, 11*b*, or 11*c*) and a coil (12*a*, 12*b*, or 12*c*) wound around the iron core. For example, the coils 12*a*, 12*b* and 12*c* may be an R-phase coil, an S-phase coil and a T-phase coil, respectively.

The peripheral iron core 2 is divided into the partial peripheral iron cores (2*a*, 2*b*, and 2*c*) by the dividing surfaces (41*a*, 41*b*, and 41*c*). The "dividing surface" may be a surface formed when cutting a peripheral iron core 2 formed as an integral unit, or may be a surface between which separately formed partial peripheral iron cores (2*a*, 2*b*, and 2*c*) contact each other by assembly. By dividing the peripheral iron core 2 into the partial peripheral iron cores (2*a*, 2*b*, and 2*c*), the coils (12*a*, 12*b*, and 12*c*) are easily wound around the iron cores (11*a*, 11*b*, and 11*c*) of the iron core coils (1*a*, 1*b*, and 1*c*) contacting or connected to the peripheral iron core 2.

The partial peripheral iron cores (2*a*, 2*b*, and 2*c*) preferably have engaging portions that are engaged with each other at the dividing surfaces. The engaging portion preferably has a fitting structure. The securing member 3 secures the partial peripheral iron cores (2*a*, 2*b*, and 2*c*) to maintain the peripheral iron core 2 in contact at the dividing surfaces (41*a*, 41*b*, and 41*c*). In FIG. 1, in a state of clamping the peripheral iron core 2 with the securing member 3, no gap is preferably formed between the outer periphery of the peripheral iron core 2 and the securing member 3.

In the example of FIG. 1, the engaging portions of the dividing surfaces (41*a*, 41*b*, and 41*c*) have a shape such as that of a straight line bended once, but the shape is not limited to this. For example, the engaging portions may have a shape such as that of a straight line bended twice or more times, or a curved shape. The dividing surfaces (41*a*, 41*b*, and 41*c*) preferably have engaging portions of the same shape in the lamination direction of the peripheral iron core 2. This facilitates contact of the dividing surfaces (41*a*, 41*b*, and 41*c*) in assembly of the peripheral iron core 2.

Since the AC reactor according to the first embodiment has engaging portions in the dividing surfaces, it is possible to prevent the occurrence of positional misalignment of the peripheral iron core at the dividing surfaces.

Next, an AC reactor according to a second embodiment of this disclosure will be described. FIGS. 2A and 2B are a plan view and a perspective view of the AC reactor according to the second embodiment, respectively. The difference between an AC reactor 102 according to the second embodiment and the AC reactor 101 according to the first embodiment is that the AC reactor 102 has securing members disposed so as to straddle the dividing surfaces (4*a*, 4*b*, and 4*c*) between the adjoining partial peripheral iron cores of a peripheral iron core 2. The other structures of the AC reactor 102 according to the second embodiment are the same as that of the AC reactor 101 according to the first embodiment, so a detailed description is omitted.

For example, as shown in FIG. 2B, a securing member 311*au* is disposed outside the peripheral iron core 2, and a securing member 312*au* is disposed inside the peripheral iron core 2 in the vicinity of an upper end of the dividing surface 4*a* in the lamination direction. A securing member 311*ad* is disposed outside the peripheral iron core 2, and another securing member (not illustrated) is disposed inside the peripheral iron core 2 in the vicinity of a lower end of the dividing surface 4*a* in the lamination direction.

In the same manner, as shown in FIG. 2B, a securing member 311*bu* is disposed outside the peripheral iron core 2, and a securing member 312*bu* is disposed inside the peripheral iron core 2 in the vicinity of an upper end of the dividing surface 4*b* in the lamination direction. A securing member 311*bd* is disposed outside the peripheral iron core 2, and another securing member (not illustrated) is disposed inside the peripheral iron core 2 in the vicinity of a lower end of the dividing surface 4*b* in the lamination direction.

Furthermore, as shown in FIG. 2B, a securing member 311*cu* is disposed outside the peripheral iron core 2, and a securing member 312*cu* is disposed inside the peripheral iron core 2 in the vicinity of an upper end of the dividing surface 4*c* in the lamination direction. Securing members (not illustrated) are disposed outside and inside the peripheral iron core 2 in the vicinity of a lower end of the dividing surface 4*c* in the lamination direction.

Each of the securing members 311*au*, 312*au*, etc., preferably has a surface shaped along an inner or outer peripheral surface of the peripheral iron core 2, and contacts the peripheral iron core 2 at the surface. For example, when the peripheral iron core 2 is round in shape, each of the securing members 311*au*, 312*au*, etc., preferably has an arc-shaped surface contacting the peripheral iron core 2.

FIGS. 2A and 2B show an example in which the securing members are disposed at the both ends, i.e., in the vicinities of the upper end and the lower end, of the dividing surface 4*a* of the peripheral iron core 2 in the lamination direction, but the present invention is not limited to this embodiment. For example, the securing member may be disposed at any one of the ends, i.e., in the vicinities of the upper end and the lower end, of the dividing surface 4*a* of the peripheral iron core 2 in the lamination direction.

The securing members 311*au*, 312*au*, etc., may be made of metal such as iron or aluminum, and secured to the peripheral iron core 2 with adhesive. However, the present invention is not limited to this example, and the securing members may be made of another material such as a resin. The metal securing members may be secured to the peripheral iron core 2 by welding or the like.

FIG. 2B shows the example in which the securing members are disposed at both ends, i.e., in the vicinities of the upper end and the lower end, of the dividing surface 4*a* of the peripheral iron core 2 in the lamination direction, but another securing member may be disposed at the middle of the dividing surface 4*a* in the lamination direction. Alternatively, an integral securing member into which the securing members are integrated along the lamination direction of the dividing surface 4*a* of the peripheral iron core 2 may be disposed instead.

Since the AC reactor according to the second embodiment has the securing members disposed so as to straddle the dividing surfaces between the adjoining partial peripheral iron cores, the securing members use a smaller amount of material than a securing member entirely enclosing the outer periphery of the peripheral iron core.

Figure 3A:
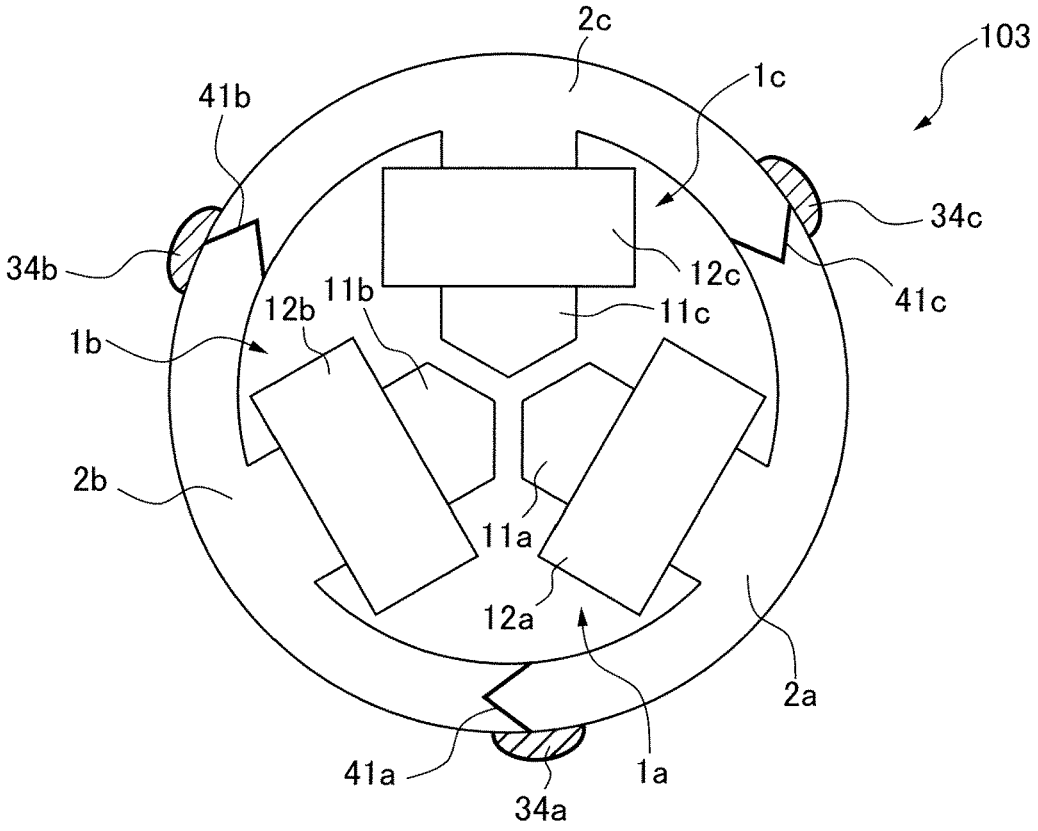
FIG. 3A is a plan view of an AC reactor according to a third embodiment.
Figure 3B:
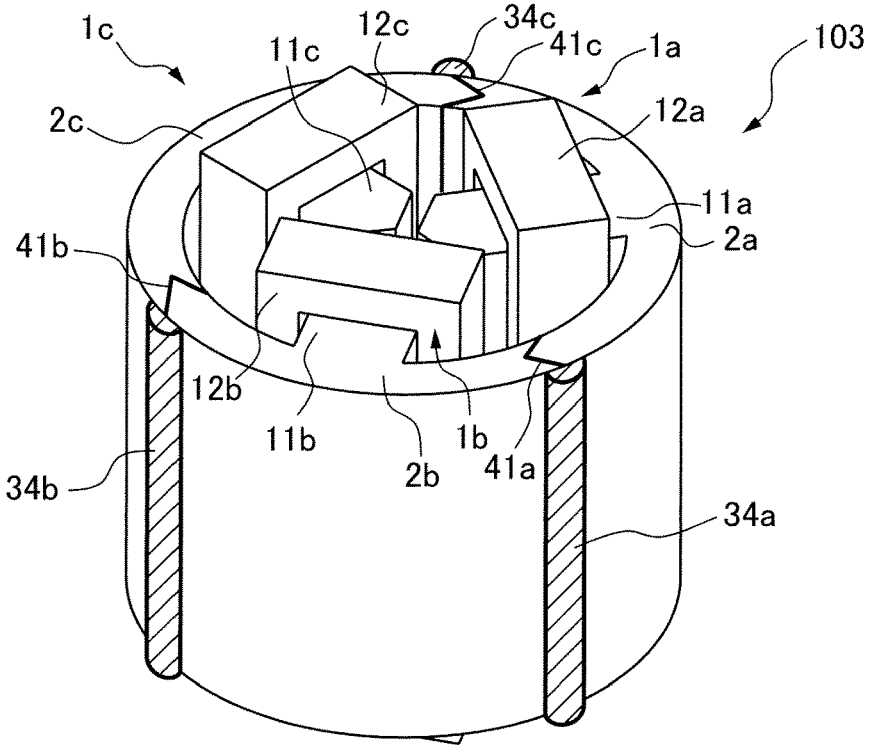
FIG. 3B is a perspective view of the AC reactor according to the third embodiment.

Next, an AC reactor according to a third embodiment of this disclosure will be described. FIGS. 3A and 3B are a plan view and a perspective view of the AC reactor according to the third embodiment, respectively. The difference between an AC reactor 103 according to the third embodiment and the AC reactor 101 according to the first embodiment is that the AC reactor 103 has securing members (34*a*, 34*b*, and 34*c*) made of a welding material or a brazing material for welding or brazing at least part of dividing surfaces (41*a*, 41*b*, and 41*c*) of a peripheral iron core 2. The other structure of the AC reactor 103 according to the third embodiment is the same as that of the AC reactor 101 according to the first embodiment, so a detailed description is omitted.

As shown in FIGS. 3A and 3B, the securing members (34*a*, 34*b*, and 34*c*) may be disposed in the dividing surfaces (41*a*, 41*b*, and 41*c*) of the peripheral iron core 2 by welding or brazing. As shown in FIGS. 3A and 3B, the securing members (34*a*, 34*b*, and 34*c*) may be disposed on portions of the dividing surfaces (41*a*, 41*b*, and 41*c*) exposed outside the peripheral iron core 2 along the lamination direction as indicated by the double-headed arrow of FIG. 2B. However, the present invention is not limited to this example, and inside portions, upper portions, or lower portions of the peripheral iron core 2 may be welded or brazed.

According to the AC reactor of the third embodiment, the divided peripheral iron core can be easily secured by welding or brazing the dividing surfaces of the peripheral iron core.

Figure 4A:
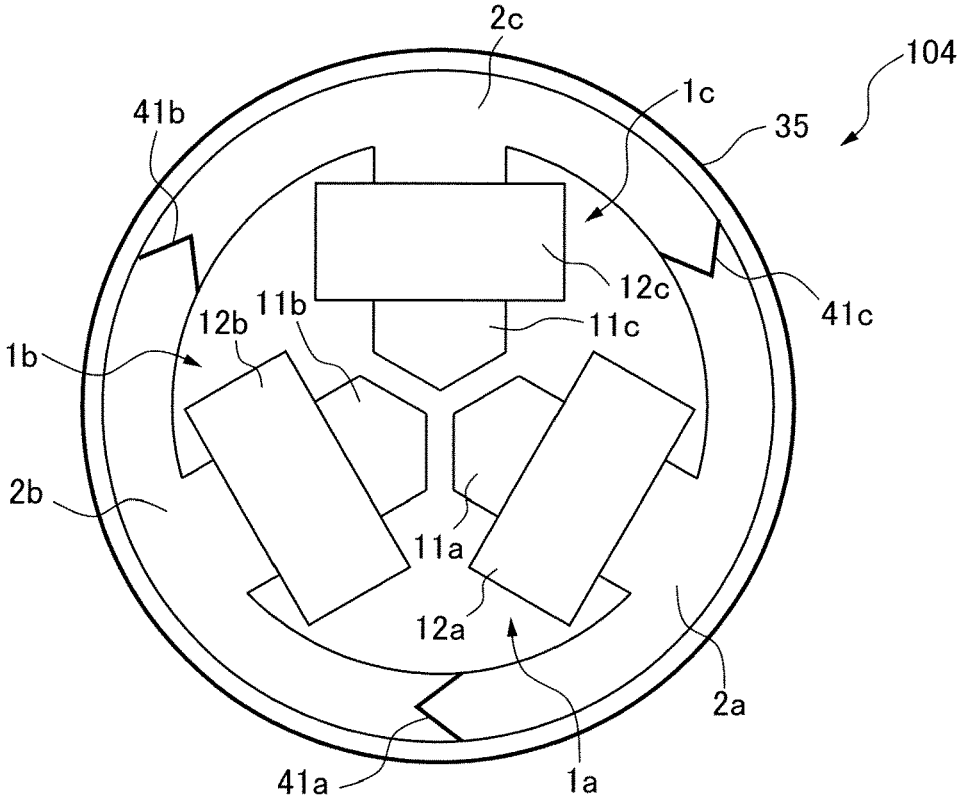
FIG. 4A is a plan view of an AC reactor according to a fourth embodiment.
Figure 4B:
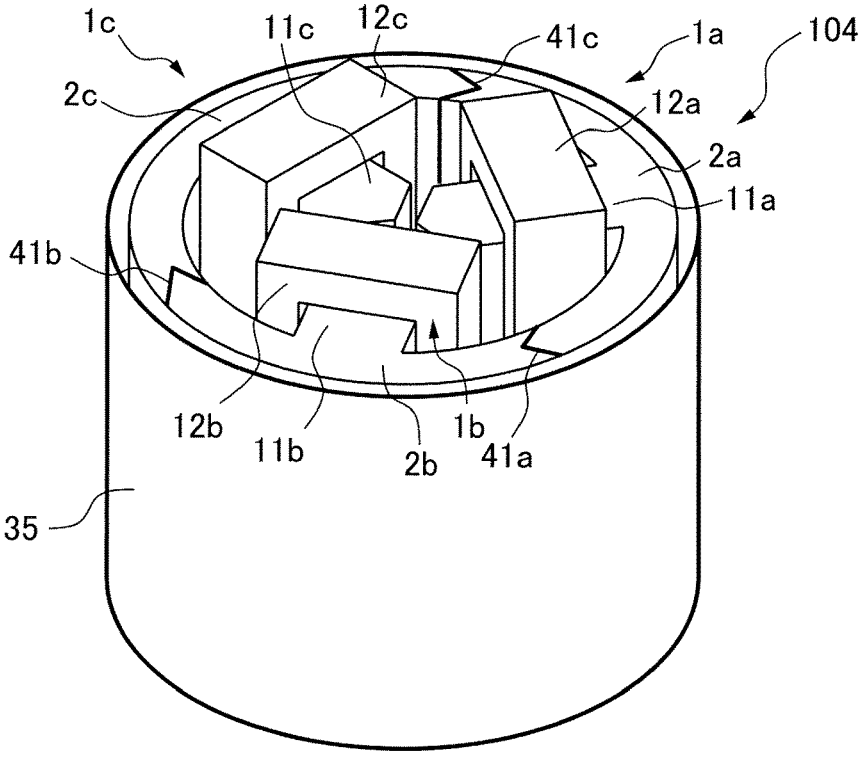
FIG. 4B is a perspective view of the AC reactor according to the fourth embodiment.

Next, an AC reactor according to a fourth embodiment of this disclosure will be described. FIGS. 4A and 4B are a plan view and a perspective view of the AC reactor according to the fourth embodiment, respectively. The difference between an AC reactor 104 according to the fourth embodiment and the AC reactor 101 according to the first embodiment is that the AC reactor 104 has a securing member 35 having a cylindrical shape is disposed so as to enclose an outer periphery of a peripheral iron core 2. The other structure of the AC reactor 104 according to the fourth embodiment is the same as that of the AC reactor 101 according to the first embodiment, so a detailed description is omitted.

The securing member 35 is preferably made of a resin, stainless-steel, aluminum, or carbon fiber. The securing member 35 is preferably made of a material that expands with increasing heat. Heating the securing member 35 makes the diameter of the securing member 35 larger than the diameter of the peripheral iron core 2, and cooling the securing member 35 makes the diameter of the securing member 35 smaller than the diameter of the peripheral iron core 2. Thus, the securing member 35 can be secured to the peripheral iron core 2 by a method called burn-fitting.

According to the AC reactor of the fourth embodiment, the securing member having a cylindrical shape is disposed so as to enclose the outer periphery of the peripheral iron core, and therefore serves to firmly secure the divided peripheral iron core.

Figure 5A:
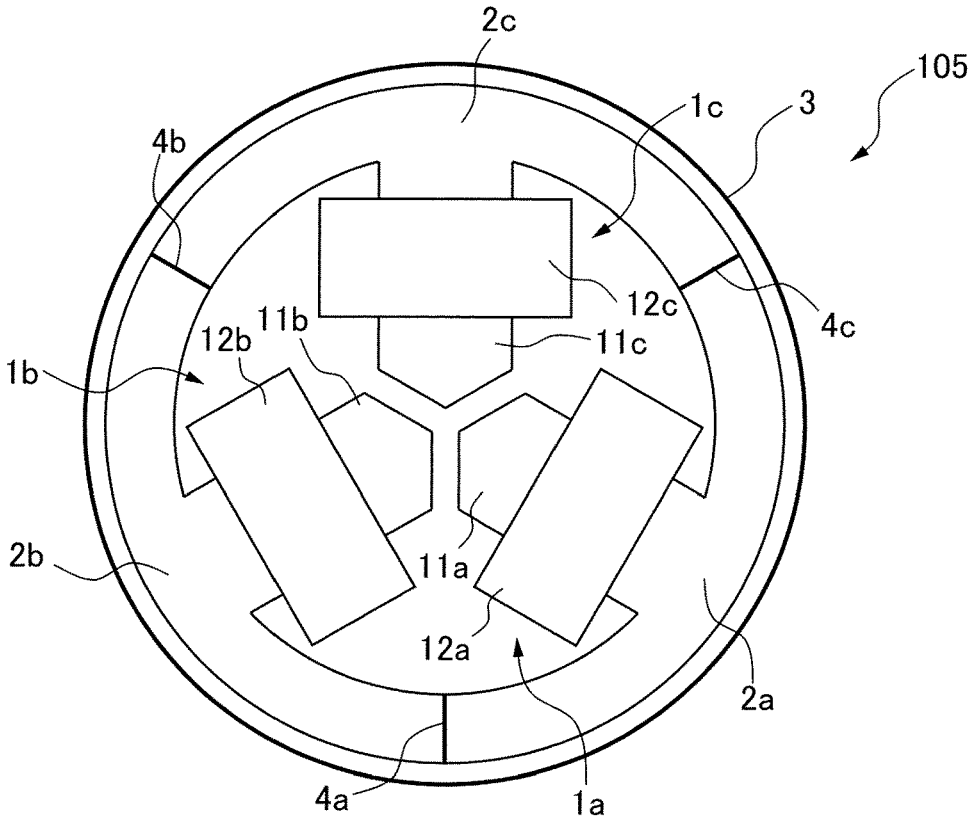
FIG. 5A is a plan view of an AC reactor according to a fifth embodiment.
Figure 5B:
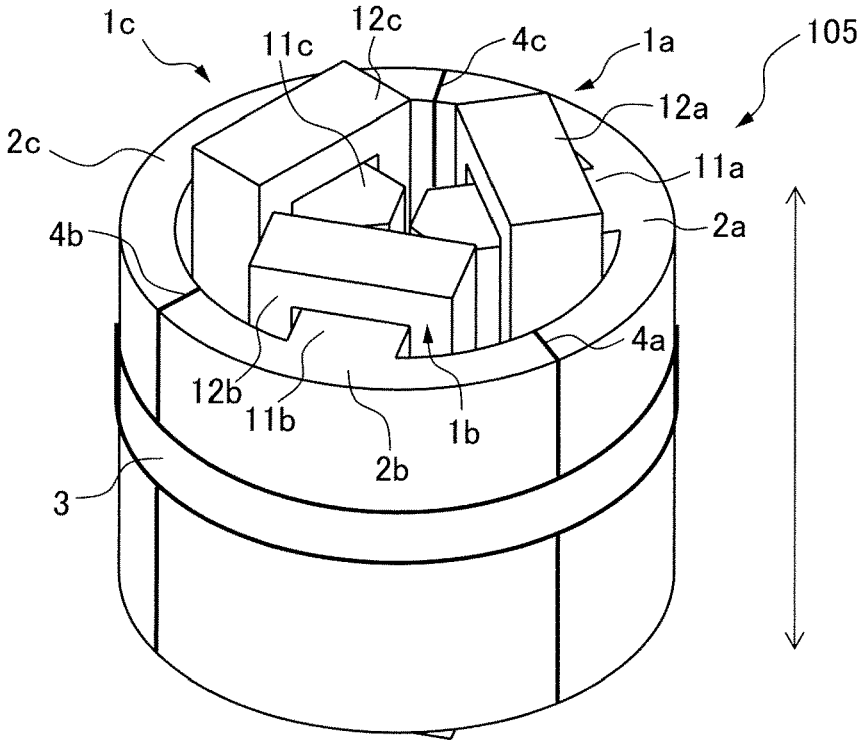
FIG. 5B is a perspective view of the AC reactor according to the fifth embodiment.

Next, an AC reactor according to a fifth embodiment of this disclosure will be described. FIGS. 5A and 5B are a plan view and a perspective view of the AC reactor according to the fifth embodiment, respectively. The difference between an AC reactor 105 according to the fifth embodiment and the AC reactor 101 according to the first embodiment is that a strip-shaped securing member 3 is disposed so as to enclose an outer periphery of a peripheral iron core 2. The other structure of the AC reactor 105 according to the fifth embodiment is the same as that of the AC reactor 101 according to the first embodiment, so a detailed description is omitted.

The securing member 3 secures partial peripheral iron cores (2*a*, 2*b*, and 2*c*) to maintain the peripheral iron core 2 in contact at dividing surfaces (4*a*, 4*b*, and 4*c*). In FIG. 5A, in a state of clamping the peripheral iron core 2 with the securing member 3, no gaps are preferably formed between the outer periphery of the peripheral iron core 2 and the securing member 3.

The securing member 3 of the AC reactor according to the fifth embodiment has a strip shape, and is disposed so as to enclose the outer periphery of the peripheral iron core 2. The securing member 3 may be made of a metal material.

The securing member 3 may have a closed shape having no end portion, or a shape having end portions. When the securing member 3 has a closed shape, the securing member 3 is heated and expanded, and thereafter fitted on the peripheral iron core 2. When the securing member 3 has a shape having end portions, the securing member 3 is wound around the peripheral iron core 2, and folded back at its end portions. The folded portions are welded, soldered, or screwed with hardware for securing.

FIG. 5B shows an example in which only one securing member 3 is disposed around the peripheral iron core 2. However, the present invention is not limited to this embodiment, and a plurality of securing members may be disposed so as to enclose the outer periphery of the peripheral iron core 2.

Figure 6:
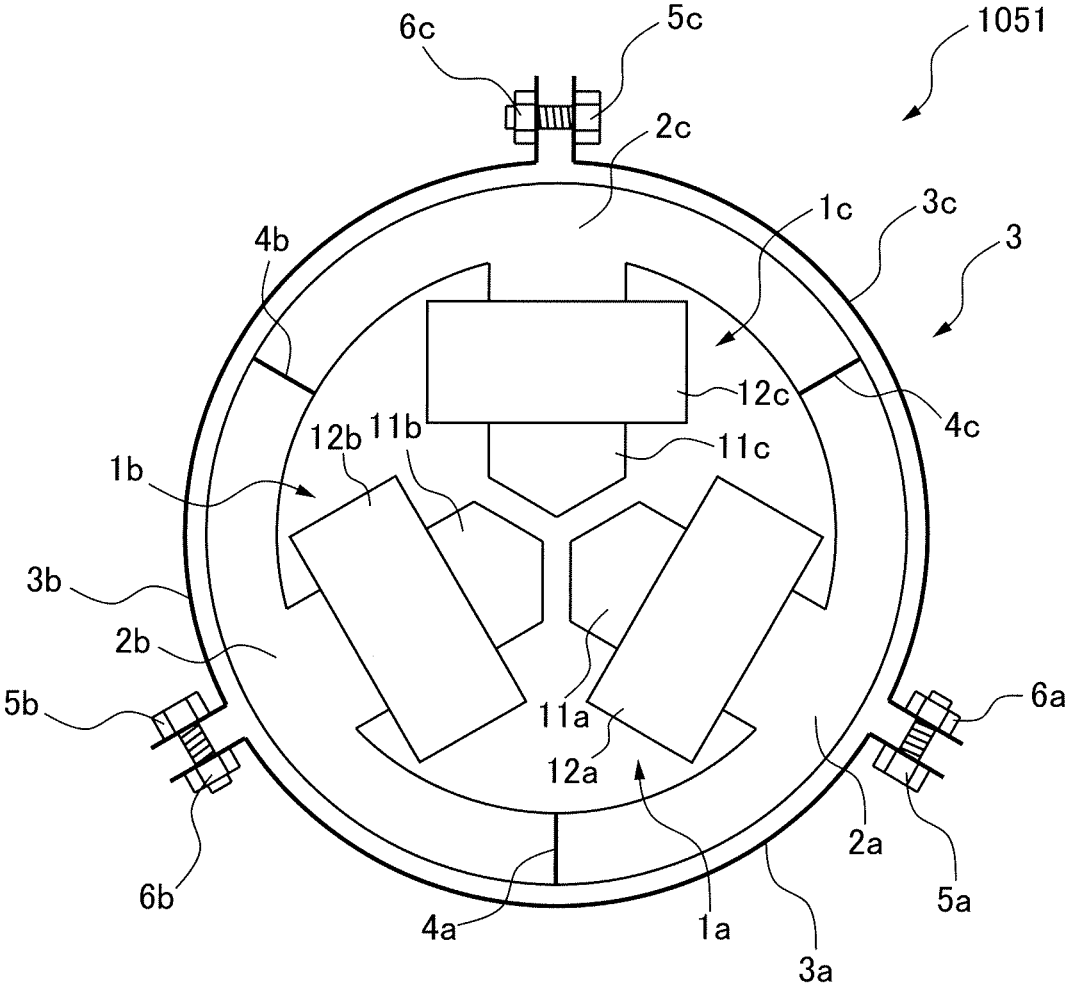
FIG. 6 is a plan view of an AC reactor according to a modification example of the fifth embodiment.

Next, an AC reactor according to a modification example of the fifth embodiment of this disclosure will be described. FIG. 6 is a plan view of the AC reactor according to the modification example of the fifth embodiment. The difference between an AC reactor 1051 according to the modification example of the fifth embodiment and the AC reactor 105 according to the fifth embodiment is that a securing member 3 is divided into a plurality of members (3*a*, 3*b*, and 3*c*) in the circumferential direction of a peripheral iron core 2. The other structures of the AC reactor 1051 according to the modification example the fifth embodiment are the same as that of the AC reactor 105 according to the fifth embodiment, so a detailed description is omitted.

The securing member 3 may be constituted of, for example, three members (3*a*, 3*b*, and 3*c*), as shown in FIG. 6. However, the present invention is not limited to this example, and the securing member 3 may be constituted of two or four or more members.

Each of the members (3*a*, 3*b*, and 3*c*) may have a strip shape. The members (3*a*, 3*b*, and 3*c*) may be made of a metal material.

As shown in FIG. 6, both end portions of each of the members (3*a*, 3*b*, and 3*c*) may be bended. The members (3*a*, 3*b*, and 3*c*) may clamp the peripheral iron core 2 with bolts (5*a*, 5*b*, and 5*c*) and nuts (6*a*, 6*b*, and 6*c*) inserted into through holes formed at the end portions. Alternatively, the members (3*a*, 3*b*, and 3*c*) may be wound around the peripheral iron core 2, and folded at the end portions. The folded end portions may be secured by welding or soldering.

The AC reactor according to the modification example of the fifth embodiment uses the securing member constituted of the plurality of members, thus facilitating clamping the divided peripheral iron core. Furthermore, the securing member, which encloses the outer periphery of the peripheral iron core, can clamp the peripheral iron core with a uniform force.

According to the AC reactor of the fifth embodiment, the divided peripheral iron core can be clamped inexpensively. Furthermore, the securing member, which encloses the outer periphery of the peripheral iron core, can clamp the peripheral iron core with a uniform force.

Figure 7A:
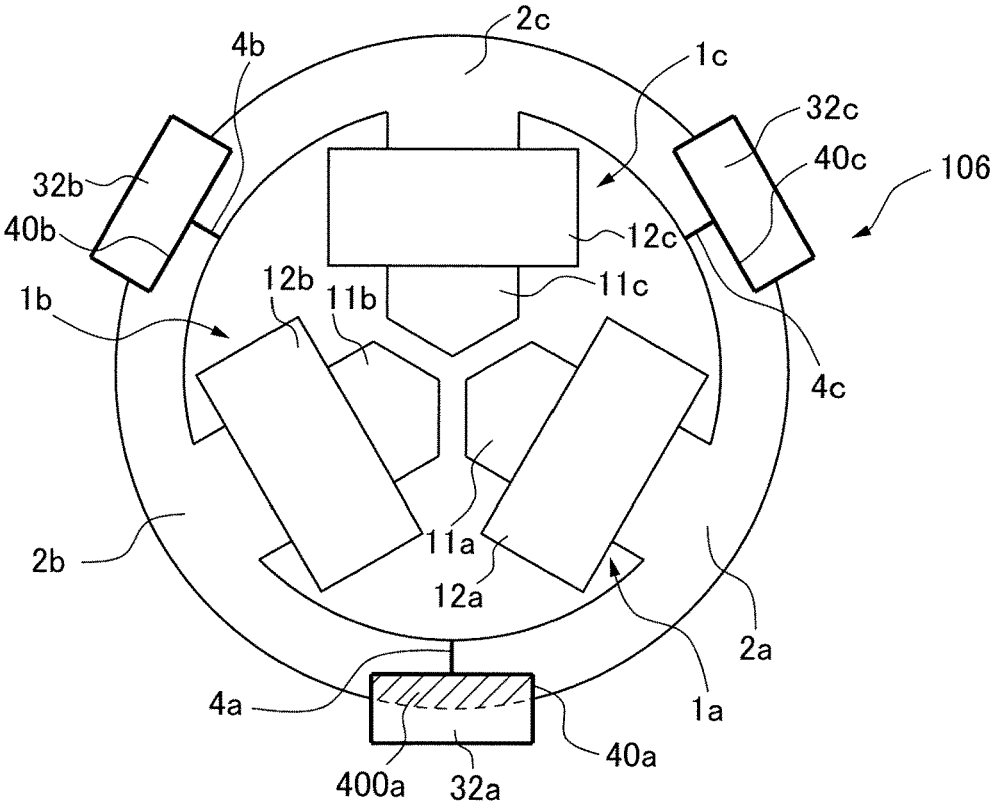
FIG. 7A is a plan view of an AC reactor according to a sixth embodiment.
Figure 7B:
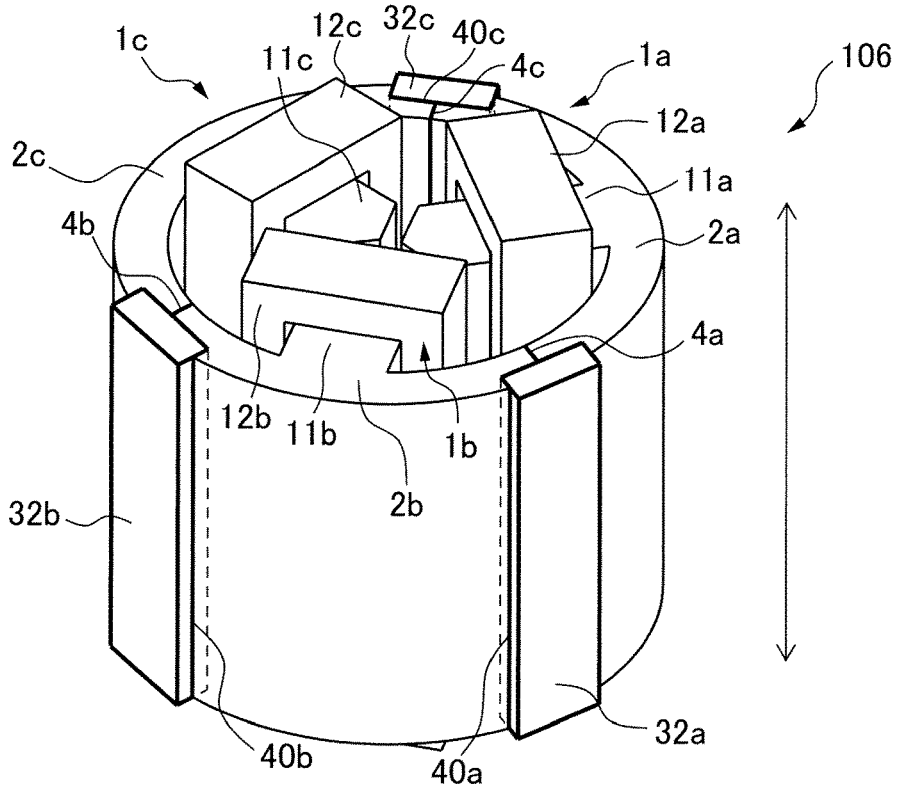
FIG. 7B is a perspective view of the AC reactor according to the sixth embodiment.

Next, an AC reactor according to a sixth embodiment of this disclosure will be described. FIGS. 7A and 7B are a plan view and a perspective view of the AC reactor according to the sixth embodiment. The difference between an AC reactor 106 according to the sixth embodiment and the AC reactor 101 according to the first embodiment is that the AC reactor 106 includes fitting portions to be fitted into fitted portions each of which is formed in outer peripheral surfaces of adjoining partial peripheral iron cores. The other structures of the AC reactor 106 according to the sixth embodiment are the same as that of the AC reactor 101 according to the first embodiment, so a detailed description is omitted.

As shown in FIGS. 7A and 7B, the AC reactor 106 preferably includes fitting portions (32*a*, 32*b*, and 32*c*) that are fitted into fitted portions (40*a*, 40*b*, and 40*c*) each of which is formed in outer peripheral surfaces of adjoining two of partial peripheral iron cores (2*a*, 2*b*, and 2*c*). For example, as shown in FIG. 7A, the engaged portions (40*a*, 40*b*, 40*c*) may be formed by cutting an area 400*a* (hatched area) on the outer surface of the division surface 4*a*.

The fitting portions (32*a*, 32*b*, and 32*c*) may be fitted into the formed fitted portions (40*a*, 40*b*, and 40*c*) in accordance with the shape of the fitted portions.

In the example shown in FIGS. 7A and 7B, the fitted portions (40*a*, 40*b*, and 40*c*) and the fitting portions (32*a*, 32*b*, and 32*c*) are provided outside a peripheral iron core 2, but the present invention is not limited thereto. For example, the fitted portions and the fitting portions may be provided inside the peripheral iron core 2 or both outside and inside the peripheral iron core 2.

The AC reactor according to the sixth embodiment includes the fitting portions to be fitted into the fitted portions each of which is formed in the outer peripheral surfaces of the adjoining partial peripheral iron cores. Therefore, since the AC reactor according to the sixth embodiment increases the contact size between the surface of the peripheral iron core and the securing member, the divided peripheral iron core can be firmly secured.

Figure 8:
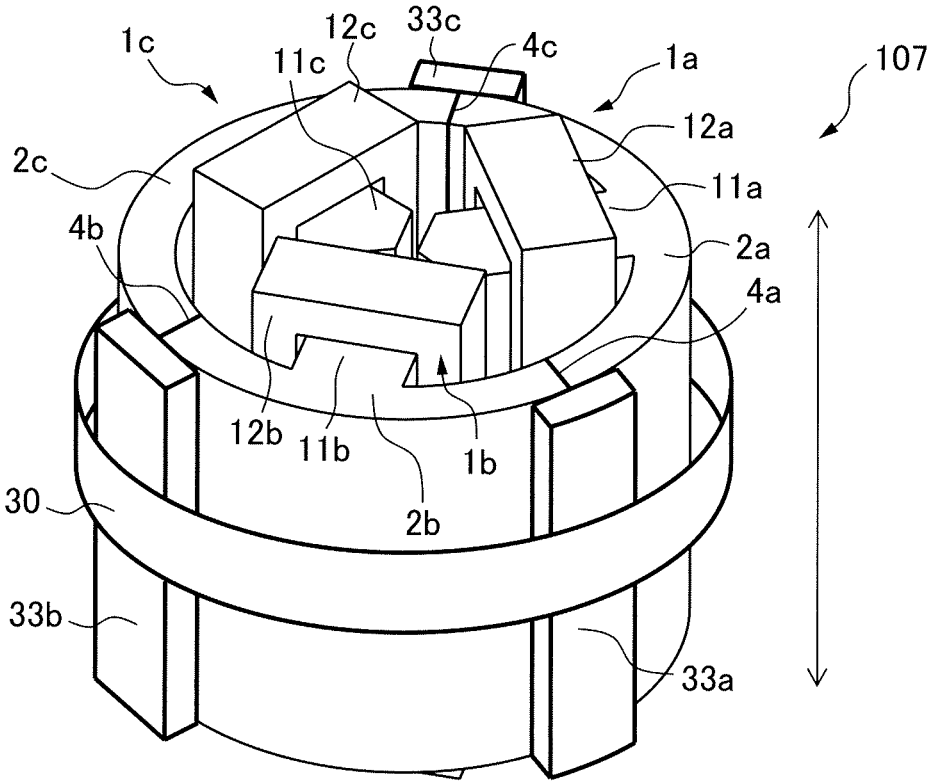
FIG. 8 is a perspective view of an AC reactor according to a seventh embodiment.

Next, an AC reactor according to a seventh embodiment of this disclosure will be described. FIG. 8 is a perspective view of the AC reactor according to the seventh embodiment. The difference between an AC reactor 107 according to the seventh embodiment and the AC reactor 106 according to the sixth embodiment is that the AC reactor 107 further includes a reinforcement member 30 disposed so as to enclose the outer periphery of the securing members (33*a*, 33*b*, and 33*c*). The other structures of the AC reactor 107 according to the seventh embodiment are the same as that of the AC reactor 106 according to the sixth embodiment, so a detailed description is omitted.

As shown in FIG. 8, the securing members (33*a*, 33*b*, and 33*c*) are disposed in the vicinities of dividing surfaces (4*a*, 4*b*, and 4*c*) of a peripheral iron core 2 along the lamination direction (the direction of the double-headed arrow of the drawing). The reinforcement member 30 is disposed so as to enclose an outer periphery of the peripheral iron core 2.

In the example of FIG. 8, the reinforcement member 30 is disposed so as to be overlaid on the securing members (33*a*, 33*b*, and 33*c*), but the present invention is not limited thereto. For example, as shown in FIG. 2B, when the securing members are disposed in the vicinities of the dividing surfaces (4*a*, 4*b*, and 4*c*) of the peripheral iron core 2 at the end portions in the lamination direction, or when the securing members are disposed inside the peripheral iron core 2, the reinforcement member 30 may be disposed so as to directly contact the peripheral iron core 2. In other words, according to the AC reactor of the seventh embodiment, both of the securing members and the reinforcement member secure the peripheral iron core 2.

According to the AC reactor of the seventh embodiment, the reinforcement member disposed so as to enclose the outer periphery of the securing members contributes to firmly securing the divided peripheral iron core.

Figure 9A:
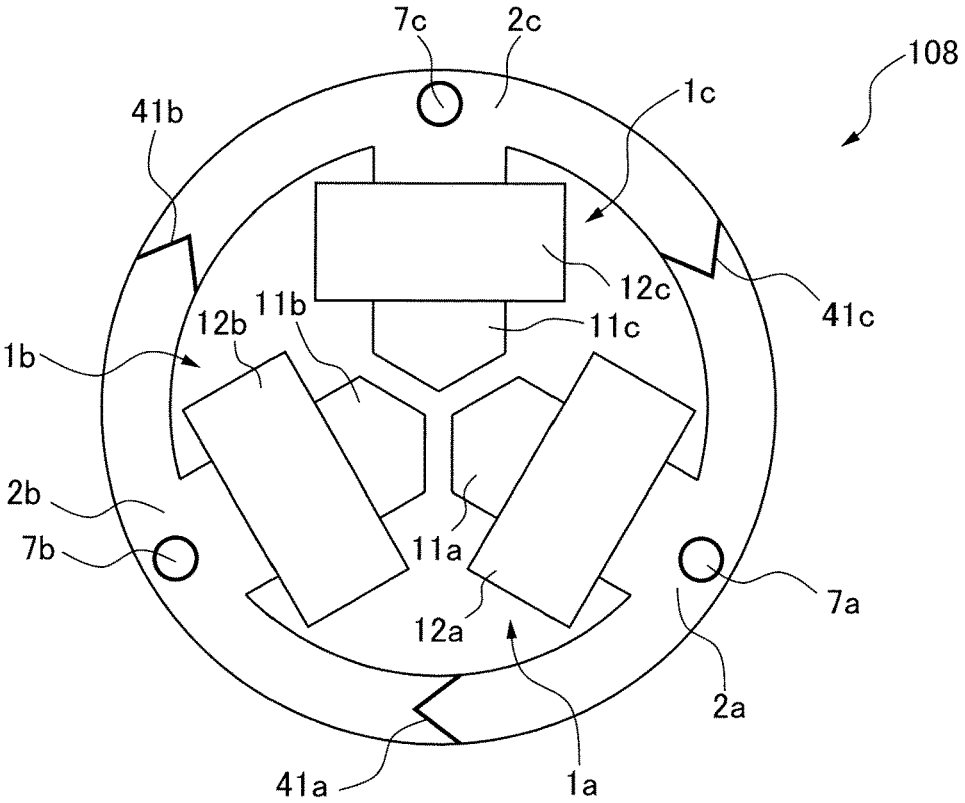
FIG. 9A is a plan view of an AC reactor according to an eighth embodiment, before a penetration rod support unit is disposed.
Figure 9B:
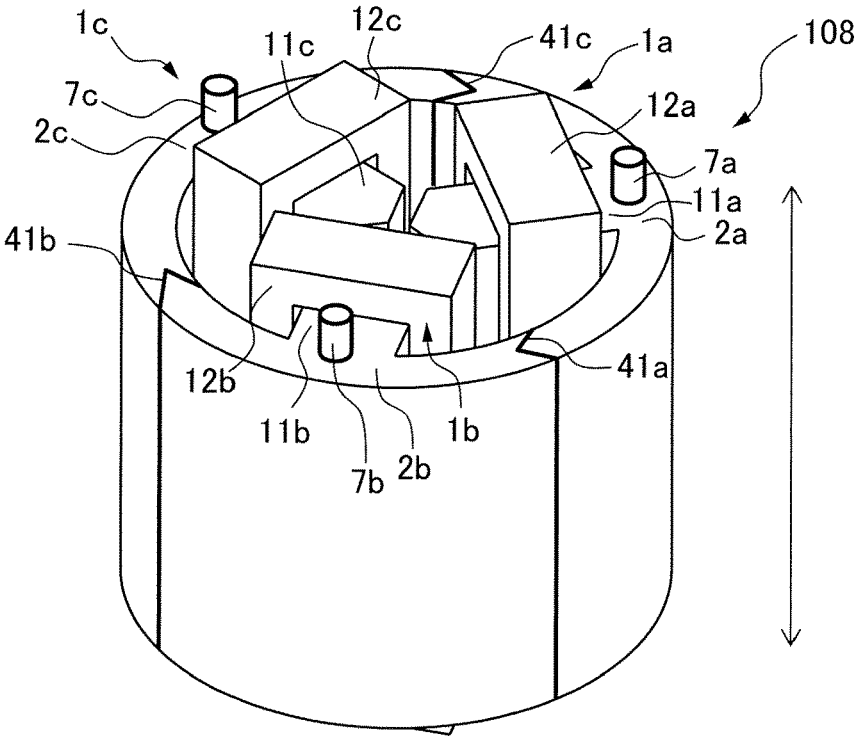
FIG. 9B is a perspective view of the AC reactor according to the eighth embodiment, before the penetration rod support unit is disposed.
Figure 10A:
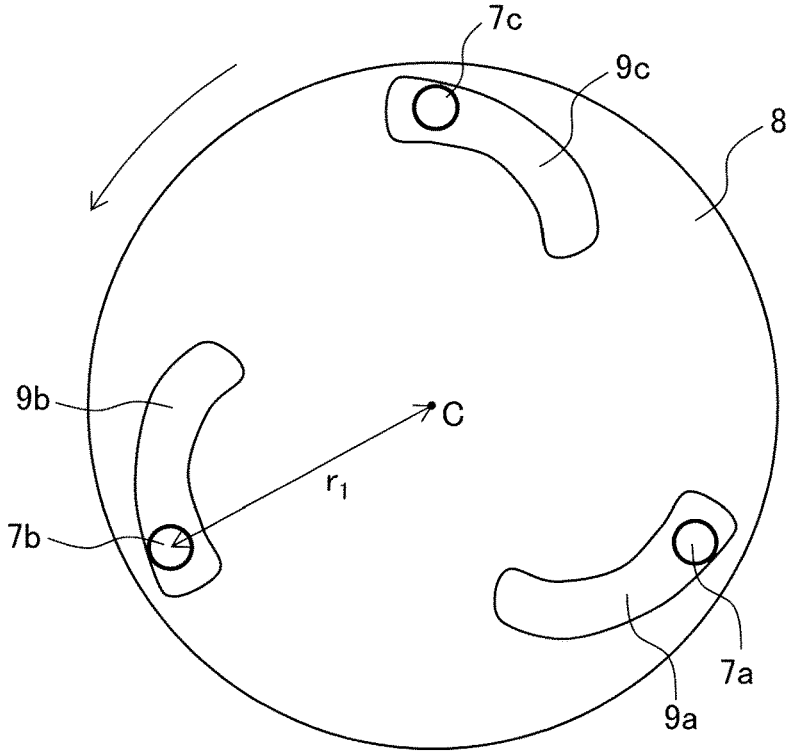
FIG. 10A is a plan view of the penetration rod support unit, before being rotated, constituting the AC reactor according to the eighth embodiment.
Figure 10B:
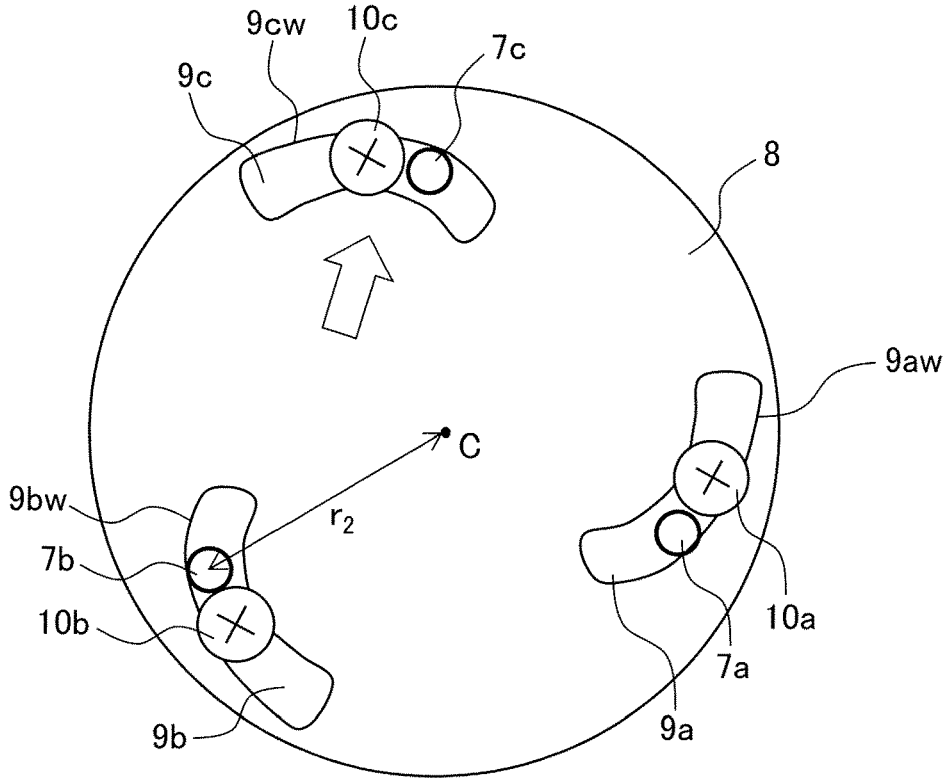
FIG. 10B is a plan view of the penetration rod support unit, after being rotated, constituting the AC reactor according to the eighth embodiment.
Figure 11:
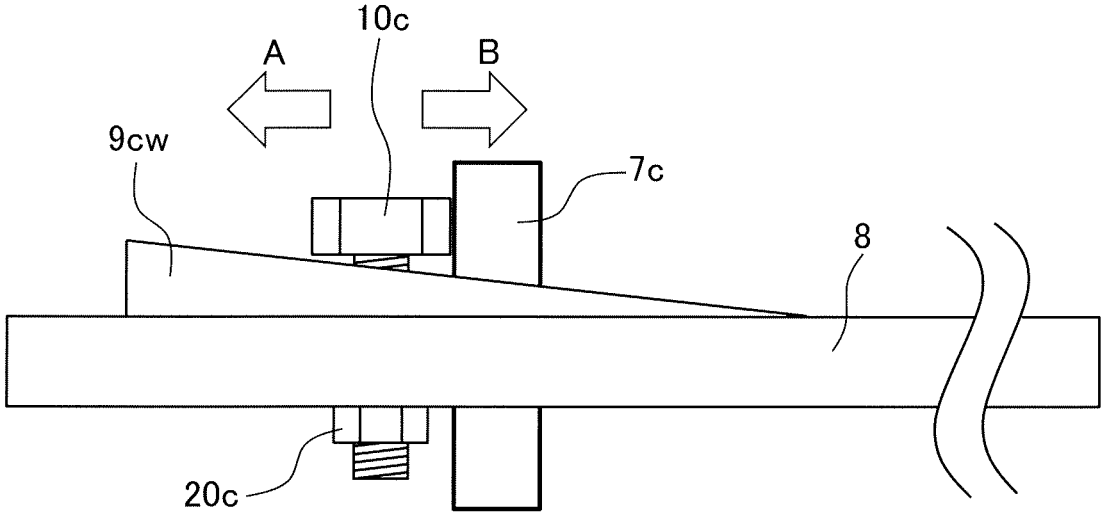
FIG. 11 is a cross-sectional view of the penetration rod support unit, after being rotated, constituting the AC reactor according to the eighth embodiment.

Next, an AC reactor according to an eighth embodiment of this disclosure will be described. FIGS. 9A and 9B are a plan view and a perspective view of the AC reactor according to the eighth embodiment, respectively. FIG. 10A is a plan view before a force is applied to a plurality of penetration rods of the AC reactor according to the eighth embodiment, in the direction toward the center of a peripheral iron core. FIG. 10B is a plan view after a force has been applied to the plurality of penetration rods of the AC reactor according to the eighth embodiment, in the direction toward the center of the peripheral iron core. FIG. 11 is a cross-sectional view after a force has been applied to the plurality of penetration rods of the AC reactor according to the eighth embodiment, in the direction toward the center of the peripheral iron core. The difference between an AC reactor 108 according to the eighth embodiment and the AC reactor 101 according to the first embodiment is that the AC reactor 108 further includes a plurality of penetration rods (7*a*, 7*b*, and 7*c*) penetrating through a divided peripheral iron core 2 in the lamination direction, and a force is applied to the penetration rods (7*a*, 7*b*, and 7*c*) in the direction toward the center of the peripheral iron core 2. The other structures of the AC reactor 108 according to the eighth embodiment are the same as that of the AC reactor 101 according to the first embodiment, so a detailed description is omitted.

As shown in FIGS. 9A and 9B, the penetration rods (7*a*, 7*b*, and 7*c*) penetrate through the divided peripheral iron core 2 in the lamination direction. In other words, the penetration rods (7*a*, 7*b*, and 7*c*) are fitted in through holes formed in partial peripheral iron cores (2*a*, 2*b*, and 2*c*) constituting the peripheral iron core 2 in the lamination direction.

As shown in FIG. 10A, a rod support unit 8 has a plurality of openings (9*a*, 9*b*, and 9*c*) that are curved toward the center C of the peripheral iron core 2 and pass the penetration rods (7*a*, 7*b*, and 7*c*) therethrough. The rod support unit 8 secures the penetration rods (7*a*, 7*b*, and 7*c*) in the openings (9*a*, 9*b*, and 9*c*).

For example, the openings (9*a*, 9*b*, and 9*c*) are curved clockwise so as to approach toward the center C of the peripheral iron core 2. The rod support unit 8 is rotatable about the center C. As shown in FIG. 10A, $r_1$ represents the distance between the penetration rod 7*b* and the center C, before rotating the rod support unit 8. The distance between each of the penetration rods 7*a* and 7*c* and the center C is also $r_1$.

FIG. 10B shows a state of rotating the rod support unit 8 counterclockwise (in the direction of the arrow of the drawing) from the state of FIG. 10A. The penetration rod 7*b* moves toward the center C, while contacting a side wall 9*bw* of the opening 9*b*. At this time, since a force to return the penetration rods (7*a*, 7*b*, and 7*c*) to their initial positions is exerted on the penetration rods (7*a*, 7*b*, and 7*c*), the positions of the penetration rods (7*a*, 7*b*, and 7*c*) are preferably secured by screws (10*a*, 10*b*, and 10*c*). Alternatively, the side wall 9*bw* of the opening 9*b* may be formed in the shape of stairs, and the penetration rod may be secured in the opening by a latch mechanism.

By rotating the rod support unit 8 counterclockwise, the distance between the penetration rod 7*b* and the center C is reduced from $r_1$ to $r_2$. In the same manner, the other penetration rods 7*a* and 7*c* move toward the center C, while contacting side walls 9*aw* and 9*cw*, respectively. As a result, since the penetration rods (7*a*, 7*b*, and 7*c*) exert a force to move the peripheral iron core 2 toward the center C, the divided peripheral iron core 2 can be firmly secured.

FIG. 11 shows a state of viewing the opening 9*c* of the rod support unit 8 from inside to outside (in the direction of the arrow of FIG. 10B). As shown in FIG. 11, the side wall 9*cw* of the opening 9*c* is preferably formed in such a manner as to be high at the outside of the rod support unit 8 and low at the inside of the rod support unit 8. This structure facilitates moving a bolt 10*c* and a nut 20*c*, which secure the penetration rod 7*c* in the rod support unit 8, to the inside (the direction of the arrow B) rather than to the outside (the direction of the arrow A), thus preventing the penetration rod 7*c* from moving outside.

The penetration rods (7*a*, 7*b*, and 7*c*) shown in FIG. 9B may be projected from a bottom surface of the peripheral iron core 2, and another rod support unit for the penetration rods (7*a*, 7*b*, and 7*c*) on the side of the bottom surface may be provided and clamped, in order to secure the divided peripheral iron core 2 more firmly.

The AC reactor according to the eighth embodiment includes the penetration rods provided in the peripheral iron core, and a force is applied to the penetration rods in the direction toward the center of the peripheral iron core, thus serving to firmly securing the divided peripheral iron core.

According to the AC reactor of any of the embodiments of this disclosure, the divided peripheral iron core can be assembled easily, while being maintained in firm contact.

What is claimed is:

1. An AC reactor comprising:

a peripheral iron core constituted of partial peripheral iron cores for enclosing an outer periphery of the AC reactor, wherein a plurality of dividing surfaces are located between adjoining partial peripheral iron cores of the peripheral iron core;

at least three iron core coils contacting, connected to, or magnetically connected to an inner surface of the peripheral iron core, each of the iron core coils including an iron core and a coil wound around the iron core; and a securing member for securing the partial peripheral iron cores to maintain the peripheral iron core in contact at the dividing surfaces, wherein the partial peripheral iron cores have engaging portions formed at an end of each of the partial peripheral iron cores and configured to engage each partial peripheral iron core at a respective dividing surface, and the securing member is secured to the peripheral iron core with adhesive.

* * * * *